US005988949A

United States Patent [19]

Will

[11] Patent Number: 5,988,949

[45] Date of Patent: Nov. 23, 1999

[54] OFFSHORE JACKET INSTALLATION

[76] Inventor: Stephen A. Will, 23203 Northhampton Pines, Spring, Tex. 77389

[21] Appl. No.: 08/781,758

[22] Filed: Jan. 10, 1997

Related U.S. Application Data

[60] Provisional application No. 60/009,894, Jan. 11, 1996.

[51] Int. Cl.[6] ..... E02B 17/02

[52] U.S. Cl. ..... 405/204; 405/227

[58] Field of Search ..... 405/195.1, 203, 405/204, 224, 227, 228

[56] References Cited

U.S. PATENT DOCUMENTS

| | | | |
|---|---|---|---|
| 3,572,044 | 3/1971 | Pogonowsei | 405/227 X |
| 4,426,173 | 1/1984 | Richari et al. | 405/204 X |
| 4,687,062 | 8/1987 | Beghetto et al. | 405/227 X |
| 4,705,430 | 11/1987 | Will | 405/227 |
| 5,356,239 | 10/1994 | Canton | 405/204 X |
| 5,573,355 | 11/1996 | Thomas | 405/227 |
| 5,867,611 | 9/1989 | Luyties | 405/204 X |

*Primary Examiner*—David J. Bagnell
*Assistant Examiner*—Frederick L. Laeniaw
*Attorney, Agent, or Firm*—Robert J. Edwards; D. Neil LaHaye

[57] ABSTRACT

An offshore jacket or compliant tower and method of installing an offshore jacket or compliant tower where the foundation piles do not initially support the jacket. The foundation piles are driven into the sea floor. Two or more temporary support piles are driven into the sea floor. Two or more docking piles are driven into the sea floor and extend a greater height above the sea floor than the foundation piles and the temporary support piles. The jacket, which includes flexpiles, is lowered into position such that it receives the docking piles. The docking piles locate and position the jacket above the temporary support piles and the foundation piles. The jacket is provided with vertical steel tubes that correspond to the location of the temporary support piles. A bulkhead in each vertical steel tube is vertically located such that the jacket is supported and leveled by the temporary support piles and not the foundation piles. The foundation piles and flexpiles are grouted before the platform is installed on the jacket.

6 Claims, 5 Drawing Sheets

OFFSHORE JACKET INSTALLATION

This application claims benefit of provisional application No. 60/009,894 filed Jan. 11, 1996.

BACKGROUND OF THE INVENTION

1. Field of the Invention

The invention is generally related to fixed offshore platforms and more particularly to the installation of an offshore jacket.

2. General Background

In the offshore oil and gas industry, a variety of floating and fixed structures are used for drilling and production operations. Fixed offshore structures are generally comprised of a jacket and a platform. The jacket is an open space frame structure formed from tubular steel and extends from the sea floor to above the water line. The platform is generally formed from one or more modules that contain the living and work areas and support the derrick and associated drilling and production equipment. The platform is supported on top of the jacket and the combination of the jacket and platform is often referred to as the offshore platform.

A key design constraint for fixed offshore structures is that there be no substantial dynamic amplification of the platform's response to waves. This is accomplished by designing the platform to have natural vibrational periods which do not fall within that portion of the range of wave periods representing waves of significant energy. The several modes of platform vibration which are generally of greatest concern in platform design are pivoting of the structure about the base (commonly termed "sway"), flexure (bending) in the vertical plane, and torsion about the vertical axis. For deep water applications, greater than about four hundred meters, the conventional rigid structure design becomes uneconomical. It then becomes necessary to use compliant platforms that give a sway period greater than the range of periods of ocean waves containing significant energy. A compliant platform uses its own inertia and flexibility to increase the sway period, thereby reducing the dynamic amplification of the platform's response to waves, which in turn reduces the structural steel needed and higher cost associated with a given increase in water depth. This is accomplished by the use of flexpiles which are tubular steel members which are attached to the legs of the jacket by a combination of a top rigid connection and slip joints along the length of the flexpiles and jacket legs. The length of the flexpiles is dependent upon the of the required flexibility of the combined tower and platform.

Installation of fixed and compliant offshore structures may be accomplished in several different ways.

For a typical shallow water structure, the jacket is set in place on the sea floor and piles are driven through the legs a suitable depth into the sea floor. The piles are typically at an angle from the vertical and are connected to the top of the jacket. Once driven in place, the piles are grouted to the legs of the jacket.

For a typical deep water structure, the jacket is provided with sleeves that are attached to the lower level of the jacket such that the sleeves are at or just above the sea floor. Piles are driven through the sleeves into the sea floor through the sleeves. These piles are normally referred to as skirt piles. The skirt piles are grouted to the sleeves once driven to the desired depth. With this configuration, buoyancy can not be provided in the sleeves as all bulkheads must be removed prior to pile installation.

In another offshore platform disclosed in U.S. Pat. No. 4,669,918, foundation piles are driven into the sea floor before the jacket is lowered into position. The jacket is then lowered into position and the jacket legs are stabbed into the foundation piles. The jacket legs are provided with bulkheads at a selected distance from the bottom of the legs such that the bulkheads rest upon the foundation piles before the bottoms of the legs rest upon the sea floor. In this manner, the bulkheads in the jacket legs and foundation piles have metal-to-metal contact and the jacket and platform are supported directly upon the foundation piles immediately upon installation of the jacket.

There are certain disadvantages to the installation method of the patent described above. The possibility of damaging the foundation piles or the flex piles is increased during the installation of the jacket, especially in deep water depths where control of the jacket section during lowering and placement on the bottom is difficult. A disadvantage of placement directly onto skirt piles is that the piles must be leveled before the jacket is placed onto the piles.

Compliant towers typically require twelve or more foundation piles. Achieving adequate levelness across twelve or more foundation piles becomes very difficult and impractical in deep waters.

SUMMARY OF THE INVENTION

The invention addresses the above disadvantages in a method provided for making a field connection of the jacket flexpiles to previously installed foundation piles. What is provided is an offshore jacket or compliant tower and method of installing an offshore jacket or compliant tower where the foundation piles do not initially support the jacket. The foundation piles are driven into the sea floor at the locations that correspond to the placement of the legs of the jacket when lowered. Two or more temporary support piles are driven into the sea floor. Two or more docking piles are driven into the sea floor and extend a greater height above the sea floor than the foundation piles and the temporary support piles. The jacket is lowered into position such that it receives the docking piles. The docking piles locate and position the jacket above the temporary support piles and the foundation piles. The jacket is provided with vertical steel tubes that correspond to the location of the temporary support piles. A bulkhead in each vertical steel tube is vertically located such that the jacket is supported and leveled by the temporary support piles and not the foundation piles. The foundation piles and legs are then grouted before the platform is installed on the jacket.

BRIEF DESCRIPTION OF THE DRAWINGS

For a further understanding of the nature and objects of the present invention reference should be had to the following description, taken in conjunction with the accompanying drawing in which like parts are given like reference numerals, and wherein.

DETAILED DESCRIPTION OF THE PREFERRED EMBODIMENT

Figure 1:
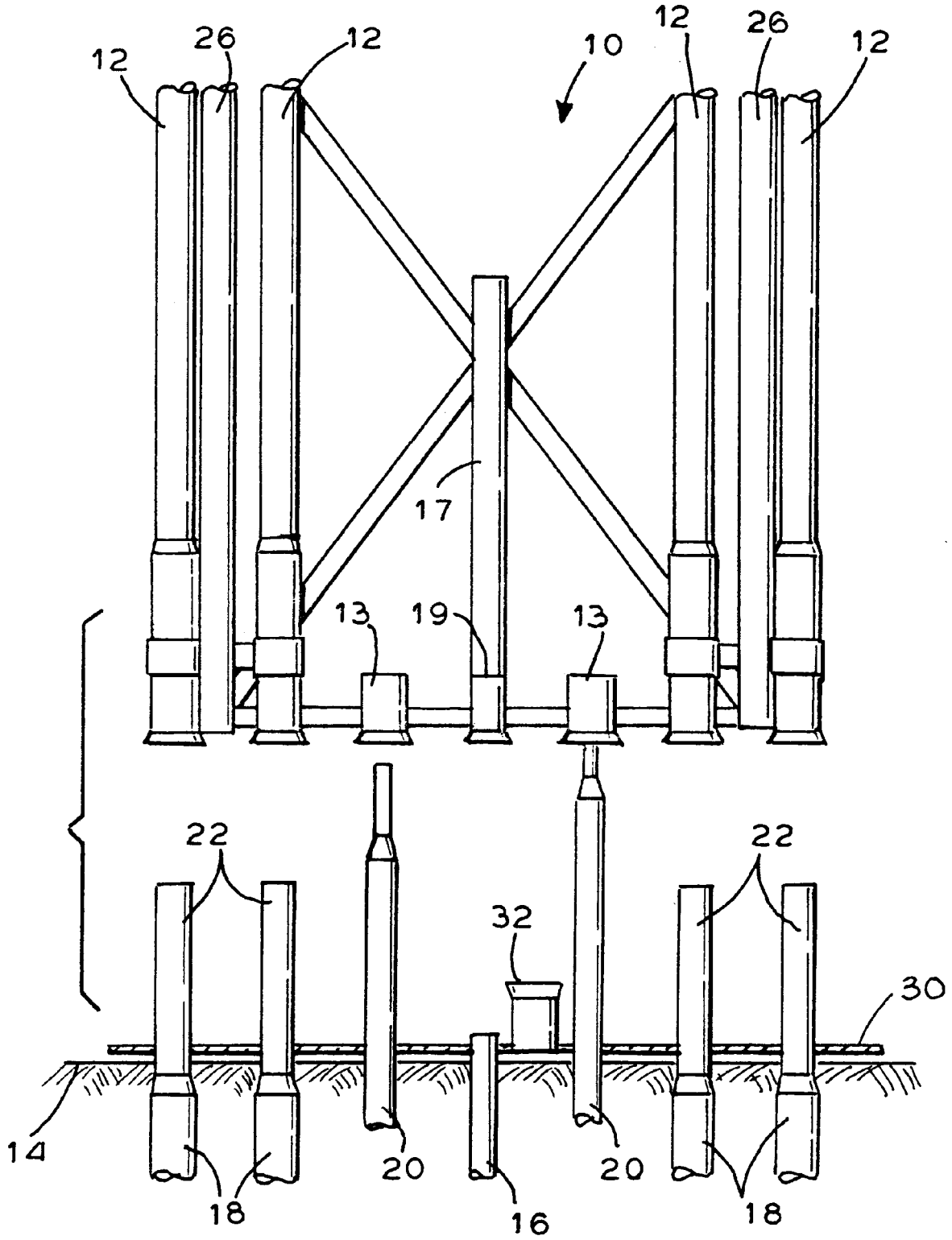
FIGS. 1–3 illustrate the sequence of installation of an offshore jacket over the pilings according to the preferred embodiment.
Figure 2:
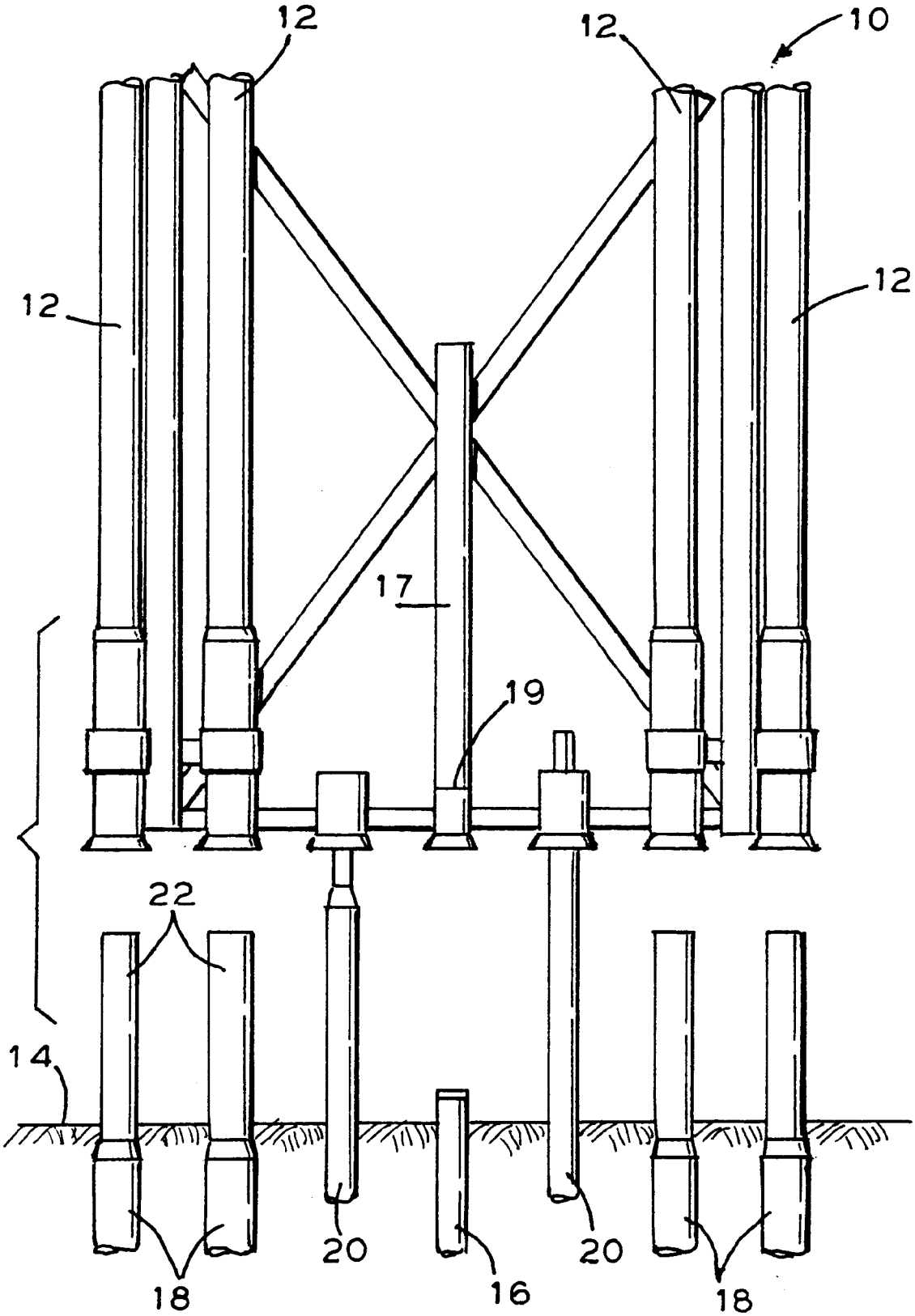
Figure 3:
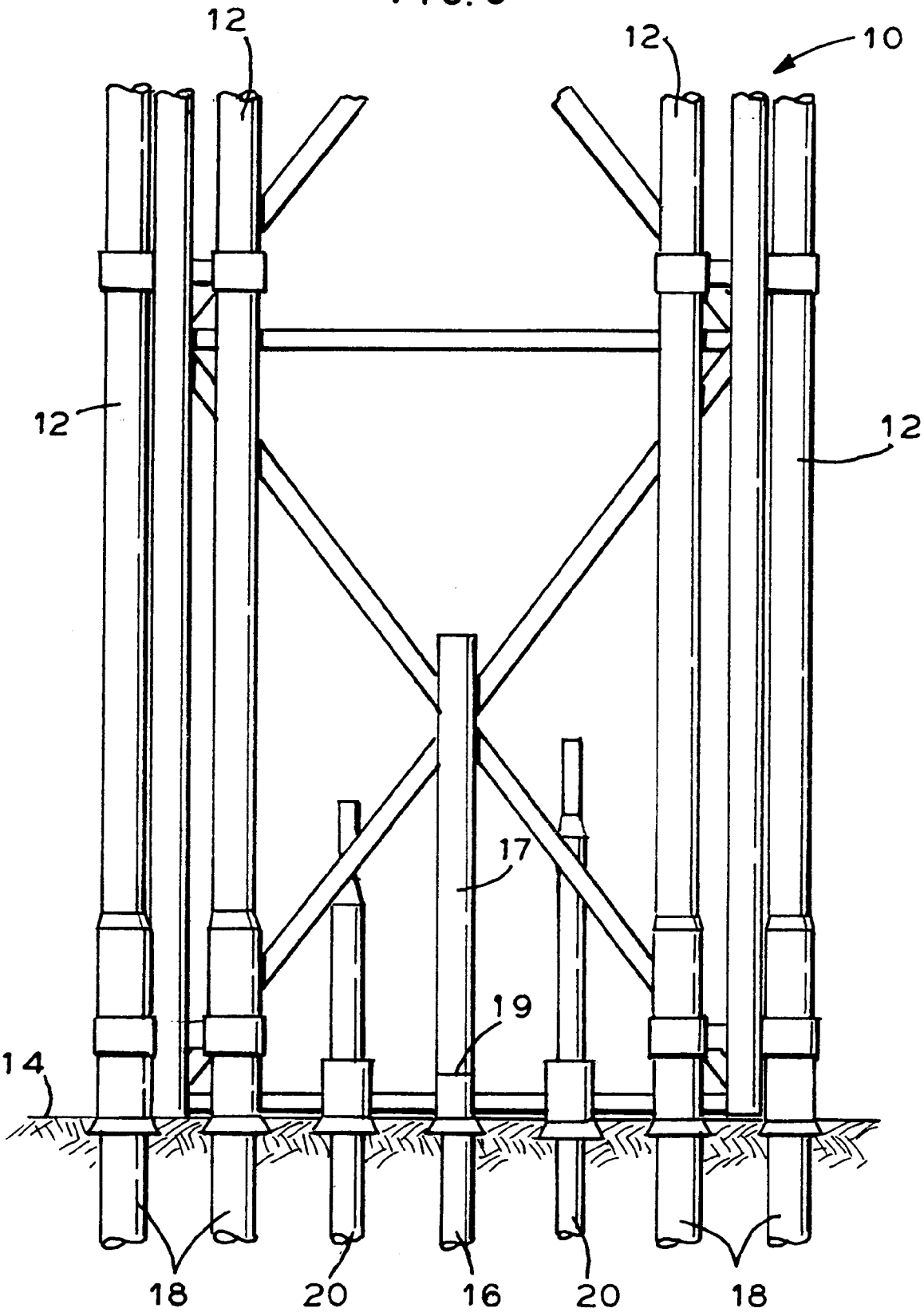

FIGS. 1–3 illustrate the lower base section of a compliant tower jacket 10 which includes a plurality of flexpiles 12. A compliant tower jacket is illustrated to show the interaction of the flexpiles on a compliant tower jacket with the foundation piles. It should be understood that the invention is also applicable to an offshore jacket which does not include flexpiles. In such a case, the legs of the offshore jacket would include sleeves attached to the legs of the jacket for receiving the foundation piles in the same manner as that described for the flexpiles of a compliant tower jacket. Therefore, reference in the description to the flexpiles should also be taken to mean sleeves which may be attached to the legs of an offshore jacket. The compliant tower jacket 10 is formed from an open space frame of tubular steel as known in the industry. Guide sleeves 13 and support tubes 17 are rigidly attached to the jacket 10 and their use will be explained below.

Various pilings are driven into the sea floor 14 and are spaced according to the corresponding location in which they interact with the jacket 10. A template 30, illustrated in FIG. 1, is used as an aid in locating at least the docking and foundation piles and possibly also the temporary support piles. The template 30 may also be provided with slots to receive conductor guides 32. This will allow conductors 34, seen in FIG. 5 to be driven into the sea floor 14 at the same time that the various piles are driven into the sea floor 14. In this manner, the template allows the conductors and piles to be installed in the proper locations.

One or more temporary support piles 16 (only one is shown for ease of illustration) are driven into the sea floor 14 such that they extend a predetermined distance above the sea floor 14. The temporary support piles 16 are only required to support the weight of the jacket 10 and so are sized and driven into the sea floor to a depth appropriate for such support. The temporary support piles 16 are located so as to be substantially coaxial with the temporary support tube 17 when the jacket 10 is in the proper position for lowering to the sea floor 14. The temporary support tubes 17 and temporary support piles 16 are required for the installation phase only and do not help to resist extreme event design loads.

A plurality of foundation piles 18 are driven into the sea floor 14 such that they extend a predetermined distance above the sea floor 14 which may be greater or lower than that of the temporary support piles 16. As seen in the drawings, the foundation piles 18 may be provided with an upper portion 22 which has a slightly smaller outer diameter than the remainder of the foundation piles. The foundation piles 18 are located so as to be substantially coaxial with the flex piles 12 when the jacket 10 is in the proper position for lowering to the sea floor 14.

Two or more docking piles 20 are driven into the sea floor 14 such that they extend a predetermined distance above the sea floor 14 which is greater than that of the foundation piles 18. At least one of the docking piles extends a greater distance from the sea floor 14 than the remainder of the docking piles 20. The docking piles 20 are located so as to be substantially coaxial with the guide sleeves 13 when the jacket 10 is in the proper position for lowering to the sea floor 14.

The template 30 is positioned in the proper location on the sea floor. The piles 16, 18, and 20 are driven into the sea floor 14. One or more conductors 34 are driven into the sea floor if preinstallation is desired. The elevation of the temporary support piles 16 above the sea floor 14 is measured. This measurement is used to determine the position of the bulkheads 19 in the temporary support tubes 17 so that the jacket 10 will be level when installed. The jacket 10 is then lowered into the water and suspended above the sea floor by the use of a crane or buoyancy or a combination of both. It should be noted that the template, piles, and conductors may be installed while the jacket is still under construction. The jacket 10 is positioned such that a guide sleeve 13 is positioned above its corresponding docking pile 20. A remotely operated vehicle (ROV) may be used during the installation process to check and confirm proper alignment before proceeding to the next step. As an example, the lower end of the jacket would be approximately fifty feet above the sea floor 14 and ten feet above the upper end of the highest docking pile 20.

The jacket 10 is then lowered as illustrated in FIG. 1 such that the highest docking pile 20 is received through its corresponding guide sleeve 13. At this point, the jacket 10 is moved such that the remaining guide sleeves 13 and docking piles are aligned and the jacket 10 is lowered onto the remaining docking piles 20 as illustrated in FIG. 2. At this point, the interaction of the guide sleeves 13 and docking piles 20 cause the flexpiles 12 to align with the foundation piles 18 and the temporary support tubes 17 to align with the temporary support piles 16. The jacket 10 is lowered over the temporary support piles 16 and the foundation piles 18 until the jacket is approximately ten feet above the sea floor 14. The vertical alignment may then be checked and adjusted if necessary. The jacket 10 is then lowered the remaining distance until the bulkheads 19 in the temporary support tubes 17 rest upon the top of the temporary support pile 16. The flexpiles 12 are then grouted to the foundation piles 18. Although not necessary, the temporary support piles 16 may then be disconnected since the grounting of the flexpiles and foundation piles will result in the foundation piles supporting the weight of the jacket and platform once the platform is installed. The platform is then installed on top of the jacket 10.

Figure 4:
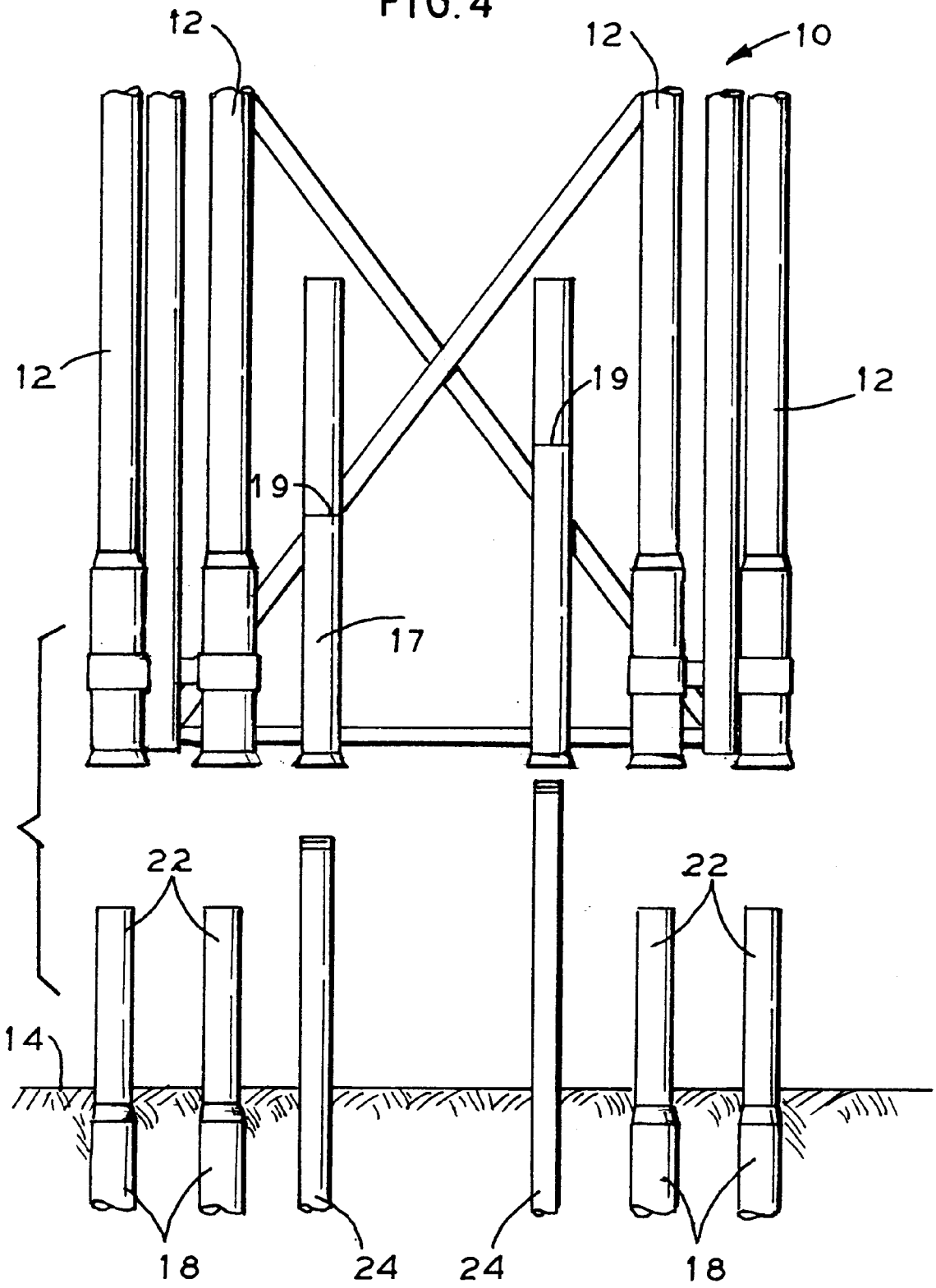
FIG. 4 illustrates an alternate embodiment of the invention.

In the alternate embodiment of FIG. 4, the separate functions of the temporary support piles and the docking piles have been combined into one set of docking/temporary support piles 24. The installation procedure is carried out in the same manner, with one of the docking/temporary support piles extending further above the sea floor than the remaining docking/temporary support piles 24 and the foundation piles 18.

Figure 5:
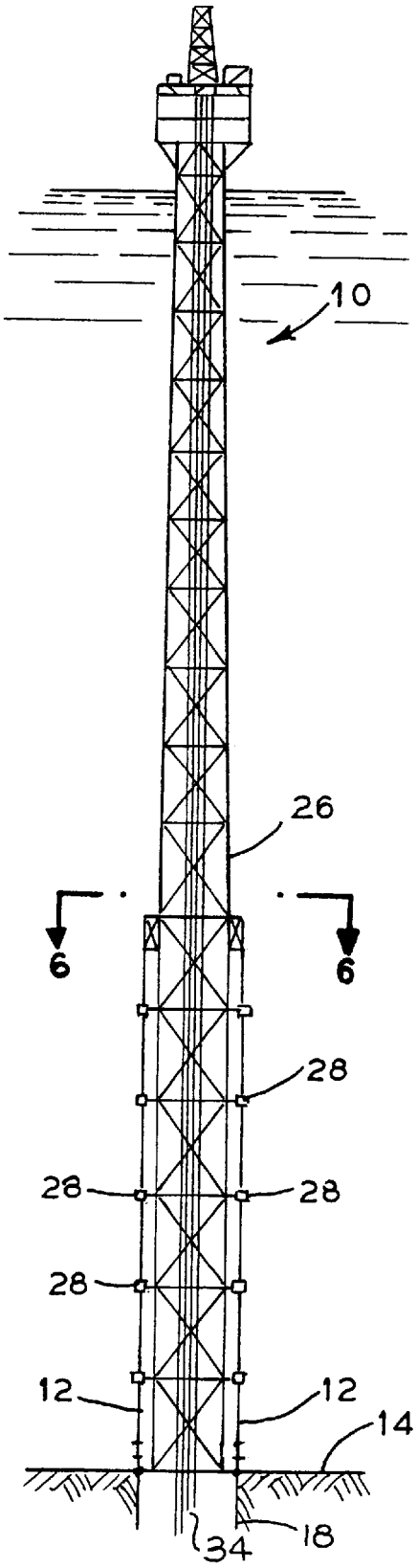
FIG. 5 is a schematic elevation view that illustrates a compliant tower.
Figure 6:
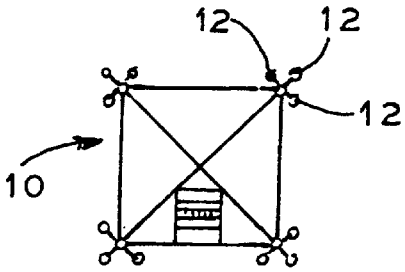
FIG. 6 is a view taken along lines 6—6 in FIG. 5.

FIGS. 5 and 6 illustrate a typical compliant tower 10 which includes 3 flexpiles 12 at each corner. It can be seen that the flexpiles 12 do not form the legs of the tower 10 but are attached to the legs 26 by means of slip joints 28.

It should be noted that various connections between the flexpiles and foundation piles may be used, including alternative grouted connections and mechanical connections.

There are several advantages to the invention. Since the metal-to-metal contact for directly setting the jacket onto the foundation piles is avoided, the possibility of damaging the critical connection between the foundation piles and flexpiles is greatly reduced. The distance that the temporary support piles extend above the sea floor is measured and used to determine the vertical placement of the bulkheads in the temporary support tube while the jacket is at the fabrication site. In this manner, the bulkheads are in place to level the jacket immediately upon installation onto the temporary support piles. This eliminates time and effort at the offshore site previously required to level the jacket. Leveling will be required only for the temporary support piles, which are fewer in number than the foundation piles. This also allows the permanent connection to be made between the jacket and foundation piles in less time and thus reduces the exposure period of the jacket to potentially severe weather which could cause damage to the jacket before the permanent connection is made. No pile sleeves are required, as the connection is direct between the flexpile and foundation pile. Buoyancy can be provided in the flexpile because bulkheads will not installation with pile installation. No mudmats are required.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for installing an offshore compliant tower jacket having a plurality of flexpiles, comprising:

a. driving a temporary support pile into the sea floor such that said temporary support pile extends a predetermined distance above the sea floor;

b. driving a plurality of foundation piles into the sea floor;

c. driving at least two docking piles into the sea floor such that said docking piles extend above the sea floor higher than said foundation piles and one of said docking piles extends higher above the sea floor than the remaining docking piles; and d. lowering the compliant tower jacket such that guide sleeves provided on the tower receive said docking piles, the flex piles receive said foundation piles, and closed end temporary support tubes provided on said tower receive said temporary support piles whereby the compliant tower jacket is supported on said temporary support piles.

2. The method of claim 1, further comprising driving conductors into the sea floor before lowering the compliant tower jacket.

3. A method for installing an offshore compliant tower jacket having a plurality of flexpiles, comprising:

a. driving a plurality of foundation piles into the sea floor such that said foundation piles extend a predetermined distance above the sea floor;

b. driving at least two docking/temporary support piles into the sea floor such that said docking/temporary support piles extend above the sea floor higher than said foundation piles and one of said docking/temporary support piles extends higher above the sea floor than the remaining docking/temporary support piles; and c. lowering the compliant tower jacket such that the flex piles receive said foundation piles and closed end temporary support tubes provided on said tower receive said docking/temporary support piles whereby the compliant tower jacket is supported on said temporary support piles.

4. A method for installing an offshore jacket having a plurality of legs, comprising:

a. providing one or more sleeves attached to the legs of the offshore jacket;

b. driving a temporary support pile into the sea floor such that said temporary support pile extends a predetermined distance above the sea floor;

c. driving a plurality of foundation piles into the sea floor;

d. driving at least two docking piles into the sea floor such that said docking piles extend above the sea floor higher than said foundation piles and one of said docking piles extends higher above the sea floor than the remaining docking piles; and e. lowering the offshore jacket such that guide sleeves provided on the jacket receive said docking piles, the sleeves on the legs of the jacket receive said foundation piles, and closed end temporary support tubes provided on the offshore jacket receive said temporary support piles whereby the offshore jacket is supported on said temporary support piles.

5. A method for installing an offshore jacket having a plurality of legs, comprising:

a. driving a plurality of foundation piles into the sea floor such that said foundation piles extend a predetermined distance above the sea floor;

b. driving at least two docking/temporary support piles into the sea floor such that said docking/temporary support piles extend above the sea floor higher than said foundation piles and one of said docking/temporary support piles extends higher above the sea floor than the remaining docking/temporary support piles; and c. lowering the offshore jacket such that the legs of the offshore jacket receive said foundation piles and closed end temporary support tubes provided on said offshore jacket receive said docking/temporary support piles whereby the offshore jacket is supported on said temporary support piles.

6. A method for installing an offshore compliant tower jacket having a plurality of flexpiles, comprising:

a. placing a template on the sea floor, said template having slots for receiving piles and conductor guides;

b. driving a temporary support pile into the sea floor such that said temporary support pile extends a predetermined distance above the sea floor;

c. driving a plurality of foundation piles into the sea floor;

d. driving at least two docking piles into the sea floor such that said docking piles extend above the sea floor higher than said foundation piles and one of said docking piles extends higher above the sea floor than the remaining docking piles;

e. driving conductors into the sea floor; and f. lowering the compliant tower jacket such that guide sleeves provided on the tower receive said docking piles, the flex piles receive said foundation piles, and closed end temporary support tubes provided on said tower receive said temporary support piles whereby the compliant tower jacket is supported on said temporary support piles.

* * * * *

UNITED STATES PATENT AND TRADEMARK OFFICE
CERTIFICATE OF CORRECTION

PATENT NO : 5,988,949
DATED : November 23, 1999
INVENTOR(S) : Stephen A. Will

It is certified that error appears in the above-identified patent and that said Letters Patent are hereby corrected as shown below:

On the title page: Item [73]

Insert Assignee: McDermott International, Inc.,
New Orleans, LA

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*